US005875979A

United States Patent [19]

Walters et al.

[11] Patent Number: 5,875,979

[45] **Date of Patent: *Mar. 2, 1999**

[54] GREEN WASTE PROCESSOR

[76] Inventors: Drake R. Walters, P.O. Box 9382; R. Fred Walters, P.O. Box 2634, both of Rancho Santa Fe, Calif. 92067

[21] Appl. No.: 2,910

[22] Filed: Dec. 31, 1997

Related U.S. Application Data

[60] Provisional application No. 60/055,089 Jul. 30, 1997.

[51] Int. Cl.[6] ..... B02C 17/20

[52] U.S. Cl. ..... 241/79.3; 241/299

[58] Field of Search ..... 241/284, 299, 241/79.3, 72

[56] References Cited

U.S. PATENT DOCUMENTS

| | | | |
|---|---|---|---|
| 788,675 | 5/1905 | Rissmuller | 241/79.3 |
| 3,614,003 | 10/1971 | Tremolada . | |
| 3,658,263 | 4/1972 | Zeisler et al. | 241/79.3 |
| 3,930,799 | 1/1976 | Eweson . | |
| 4,036,440 | 7/1977 | Makila et al. . | |
| 4,136,832 | 1/1979 | Morita et al. . | |
| 4,480,797 | 11/1984 | Weiss . | |
| 4,635,860 | 1/1987 | Kruyer . | |
| 5,716,013 | 2/1998 | Benson et al. | 241/299 |

FOREIGN PATENT DOCUMENTS

| | | | |
|---|---|---|---|
| 2462944 | 3/1981 | France | 241/79.3 |
| 5-337390 | 12/1993 | Japan | 241/79.3 |
| 850196 | 7/1981 | U.S.S.R. | 241/79.3 |
| 1757728 | 8/1992 | U.S.S.R. | 241/299 |

*Primary Examiner*—Mark Rosenbaum
*Attorney, Agent, or Firm*—Frank G. Morkunas

[57] ABSTRACT

An apparatus for processing green waste comprising a sectional rotatable drum having therein as components a plurality of first blade members, a plurality of second smaller blade members, a plurality of longitudinal platforms each having teeth-like projections on their perimeter, a plurality of spikes, and an end cap with radial members thereon to retain larger material within. The radial members have additional teeth-like members thereon to further assist in the processing of green waste. Upon discharge of the processed green waste, one or more screening members adjacent to a discharge end permit passage of varying sizes of processed material. The components, including the teeth-like members on the radial members, may be removable.

36 Claims, 3 Drawing Sheets

GREEN WASTE PROCESSOR

CROSS REFERENCES TO RELATED APPLICATIONS

This application claims the benefit of a previously filed Provisional Application, Ser. No. 60/055,089, filed on Jul. 30, 1997.

STATEMENT REGARDING FEDERALLY-SPONSORED RESEARCH OR DEVELOPMENT

Not Applicable

BACKGROUND OF THE INVENTION

The current manner of processing discarded vegetation and wood, referred to as green waste, entails grinding the green waste in one device and then sifting or screening the usable material in another device; generally an open-top tub-like grinder, referred to as a tub grinder, having large hammers, teeth or blades impacting material under very high torque. The device operates in a blender-like fashion. Problems associated with this method include the generation and release into the environment of volumes of dust and debris, movement of large volumes of ground material to another device for screening processed waste, and limited sifting and sorting options. Plastic container bags of green waste must be opened and trash therein sorted before being placed into a grinder. The grinder also receives grass, sand, dust, and other small particles not requiring grinding by such a device. This grass, sand, dust, and smaller particles cause excessive wear on the grinder due in part to the moisture or coarseness of the material.

Green waste is loaded into the tub grinder from the top. In addition to the hammer and teeth or blades, the grinder relies on gravity and the weight of the material in its processing. Because of this operating principal, the motor to operate this grinder and turn the grinding tools burdened by the weight of the materials thereon must be extremely powerful. In spite of its power, it is not suited for fibrous materials such as palm tree waste (palms, trunk, and bark) and yucca plants and moist material such as ice plant and grass. These green waste materials cause the grinder generally to become impeded in its operation or to jam.

In addition, this grinder is costly to manufacture and is expensive to operate. Excessive jamming and down time adversely affect its efficiency and effectiveness. Because huge quantities are loaded into the grinder from the top, it is difficult to screen out unsuitable green waste. Large metal objects or rocks can damage or break the hammer and teeth. To provide for such screening requires manpower thereby further increasing the cost of operation.

Though the grinder can process such material quickly, it generally does so much more quickly than most recycling processing centers receive such material to process. Because of this, and because of the costs to maintain and to operate the grinder, these recycling processing centers usually collect and stockpile their green waste until'such time that a sufficient volume has been received to make operation of the grinder cost-efficient. Grinding, therefore, is periodic. These delays in processing result in a decomposition of the material with the concomitant creation and emission of unpleasant odors. The present invention processes the material as it is received and aerates the processed material thereby precluding the creation and emission of unpleasant odors.

Another waste processor is found in U.S. Pat. No. 3,930,799, issued to Eweson on Jan. 6, 1976. This apparatus is designed for producing organic fertilizer by fermentation. It provides for a large rotatable drum and a series of blades and chains within to grind materials placed therein. It best operates with several compartments within the drum to permit the ground material to stand and ferment and to pass through apertures between the inner compartments to the next compartment. Excluded from processing are materials such as wood. The drum, with its interior configuration, is designed to rotate slowly, about 10–60 revolutions per hour. The Eweson apparatus is not suited for green waste and wood materials.

U.S. Pat. No. 3,614,003 issued on Oct. 19, 1971, to Tremolada processes scrap lead batteries. It has a rotatable drum with a decreasing diameter from beginning to end, lifting wings (or platforms) for lifting the batteries and dropping and crushing them against the opposite side wall of the drum as it rotates, a continuous spiral bar to move the material within from front to rear as it processes, and a screening means to permit passage of finely processed materials. This device, like the prior patented apparatus is not suited for processing green waste and wood.

SUMMARY OF THE INVENTION

The problems noted above are overcome by the present invention. Briefly stated, the present invention contemplates a rotatable device having, on its inner surface, a plurality of first processing members, generally a plurality of large upstanding fins or blades inwardly angled at a intake end, followed by a plurality of second processing members, generally a plurality of smaller upstanding blades thereafter, also inwardly angled. Interspaced about each processing member are a plurality of spikes and platform projections for lifting and releasing materials within the inner surface so that the material being processed aids in the entire processing operation. Each processing member, spike, and platform is adapted to process green waste and wood therethrough. The waste is sorted into a plurality of finished by-products in an economical, safe, and environmentally efficient manner.

Accordingly, several objects and advantages of the present invention are to provide:

a. a safe and economical method of processing all forms of green waste and wood regardless of size and texture;
b. an apparatus that can operate continuously with virtually no clogging or jamming;
c. an apparatus which is flexible in operation and easy to maintain and modify as warranted by the processing circumstances;
d. an apparatus which uses materials which are normally difficult to process to its processing advantage; and
e. an apparatus which requires little or no supervision as to waste material introduced therein.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Figures 1, 11:
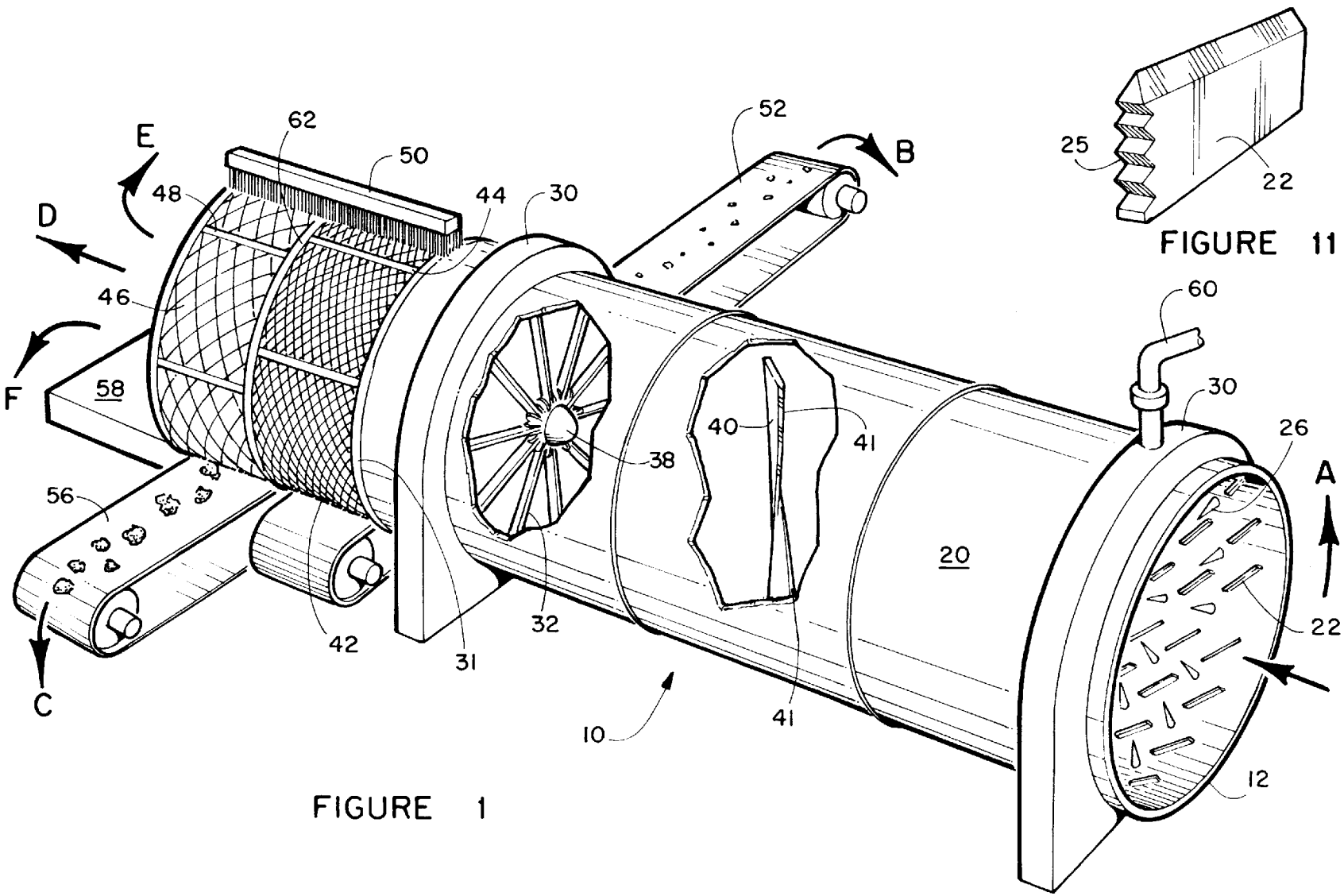
FIG. 1 is a perspective view, with a sectional view thereon, depicting the present invention.
FIG. 11 is a detailed view of the leading edge of the blades.

Referring now to the drawings in detail and in particular to FIG. 1, reference character 10 generally designates an apparatus constructed in accordance with a preferred embodiment of the present invention. Throughout the Figures, reference arrow 'A' represents the rotational direction of the apparatus and reference arrow 'Z' represents the direction of travel of the material through the apparatus.

A rotatable drum 20, which can consist of a single drum or plurality of removable and interchangeable sections, or other suitable container means, comprises the main body of the apparatus. The drum 20 may be circular or polygonal having a longitudinal axis and an inner surface. It is to be understood that the container may be comprised of any shape adapted to the movement of matter therethrough.

Because of the nature of green waste involved, the drum 20 of the apparatus may range is size from about 25 feet and up. Generally 25 to 90 feet is sufficient with a inside diameter of about 5 to 15 feet. These are the ranges of dimensions which will be used in establishing relative dimensions or ratios with the respective ranges of dimension of the other elements of the apparatus described below. The apparatus may be made larger or smaller, but when so made, provided its other elements maintain the range of dimensions described accordingly, the apparatus will function effectively and efficiently.

At the front end is the intake end 12 where green waste is introduced into the apparatus. It has been found that a general purpose hopper is best suited for this purpose to thereby facilitate loading by manual enterprise, by conveyor belt, or by other automated or semi-automated processes. All sizes of green waste, from large to small (huge stumps of wood to grass), can be so introduced. At the other end, the discharge end 31, is an end cap 30 followed by a screening or sifting member having suitable apertures to permit passage of finished waste products but not unwanted residue which may require further processing. In this configuration, the screening member is structured of two such screening members 42 and 46, though it may consist of only one or more than two and may be separated therebetween by a solid area (one or more conveyor separators) 62 to thereby facilitate the separation process. Given the nature of this apparatus, the apertures of the screening member generally do not exceed 4.000 inches.

In the preferred embodiment having two screening members, the first screening member 42 is generally made up of smaller openings or apertures from about 0.125 inch up to about 0.625 inch. The screening members may range in length from about 2 to 20 feet in ratio relation to the drum size ranges described above. A mesh-type screen is preferred but any screening member suited for the intended purpose will suffice. What is important are the openings. With a mesh-type screen, because of the large volumes, and weight, of green waste this processor can process, the screening member may be buttressed with one or more first support members or bars 44.

Because this screening member is adapted to screen finely ground green waste to be used as mulch (fine mulch or top mix), better finely ground green waste suited for this purpose is obtained with apertures of about 0.500 inch. Green waste which does not screen through the first screening member 42 is residue which passes on to the second screening member 46.

The second screening member 46 is generally made up of openings or apertures larger that those of the first screening member. These can range from about 1.500 inches up to about 4.000 inches. What is intended to be screened here generally is regular mulch or chips (wood chips). This screened material is coarser or thicker. Regular mulch is better suited and generally used as a top ground layer for weed control and water conservation purposes or for erosion control. Wood chips (also referred to as clean wood) and regular mulch can range in size based on the respective apertures. Clean wood is generally used by by energy generation plants to burn and generate energy. These plants are commonly known as co-gen plants.

Good regular mulch and clean wood are obtained from apertures sized between about 1.500 inches to about 2.500 inches. Best regular wood and clean wood, however, is obtained from apertures sized at about 2.000 inches. In must be understood that the opening sizes can vary depending on the needs of the particular user and apertures larger than 4.000 inches may be provided.

Like the first screening member 42, the second screening member 46 may be made of any material suited for the intended purpose. A mesh-like screening is preferred. With a mesh-type screen, because of the large volumes of green waste this processor can process, this screening member also may be buttressed with one or more second support members or bars 48.

A first conveyor 52 and and a second conveyor 56 are positioned under the first screening member 42 and the second screening member 46, respectively. A typical conveyor belt is, shown as the conveyors of choice though any conveyor mechanism suited for the intended purpose may be utilized. Finely ground green waste (fine mulch) and residue (regular mulch and clean wood) are conveyed from the apparatus for re-use. A conveyor separator 62 separates adjacent conveyors.

A third conveyor 58, generally transverse to the other two, is positioned at the far end of the apparatus. This conveyor transports larger residue not previously screened either through the first screening member 42 or the second screening member 46 for final discarding or re-entry into the apparatus.

At a point between the intake end 12 and the discharge end 31, there is a cutting member 40. The cutting member 40 is connected to the inner surface of the drum and rotates therewith. Its length is approximately that of the inside diameter of the drum. It has cutting edges 41 facing in the direction of rotation of the drum. The cutting edges 41 may also be slightly angled, either toward intake end 12 or toward the discharge end 31, to facilitate a cutting or chopping action on large debris passing therethrough. One purpose of the cutting member is to dislodge, by cutting or chopping, large debris becoming congested 20 in the drum and impeding the flow of green waste therethrough. The preferred placement of the cutting member 40 is approximately midway between the intake end 12 and the discharge end 31.

In operation, green waste is introduced into the apparatus 10 at the intake end 12. The rotatable drum 20 is rotated by any conventional means suited for the intended purpose, including but not limited to roller bearings (electrically or hydraulically operated), gears, or rotatable tires under the drum. Depending on the nature and scope of the processing operation, a rotation of between about 6 RPM to about 14 RPM has been found suitable for maximum effectiveness. The apparatus 10 may also be angled slightly to assist in the movement of green waste therethrough with the intake end 12 elevated above the level of the discharge end 31. The angle suited for the intended purpose may range from about 1.0 degrees to about 5.0 degrees.

Figure 2:
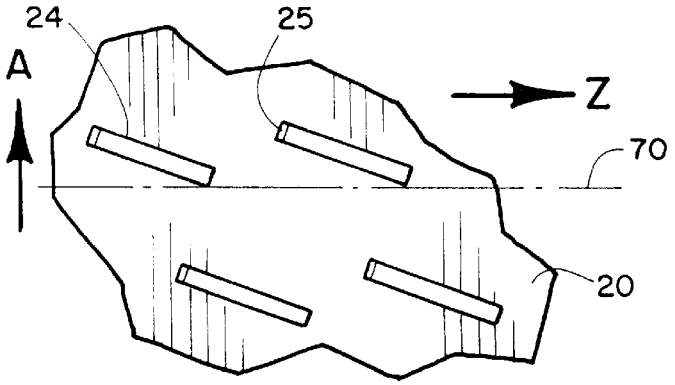
FIG. 2 is a partial plan view of the inner surface of the drum showing the augured blade configuration.
Figure 3:
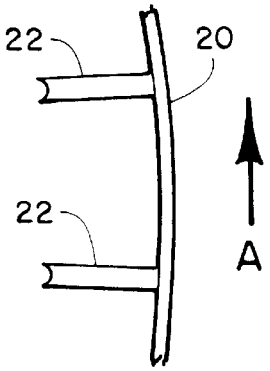
FIG. 3 is a partial end view of a 'slice' of the inner surface of the drum showing the vertical alignment of the blades.
Figure 5:
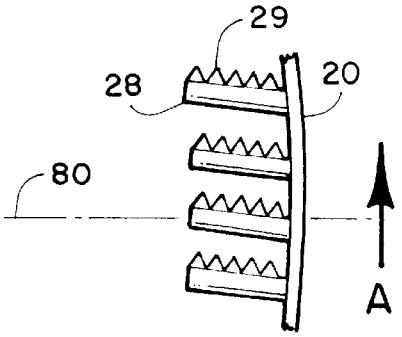
FIG. 5 is a partial end view of the inner surface of the drum showing the vertical alignment of the platform configuration.
Figure 6:
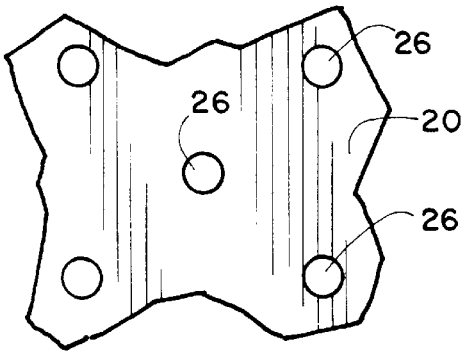
FIG. 6 is a partial sectional view of the inner surface of the drum showing the spikes.
Figure 7:
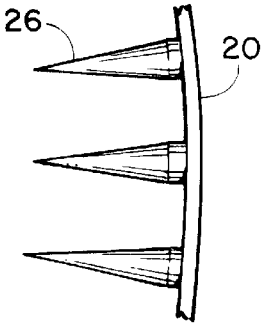
FIG. 7 is a partial end view of the inner surface of the drum showing the spikes.

The configuration of the plurality of first blades 22 are best illustrated in FIGS. 2 and 3. Reference numeral 70 in FIG. 2 represents the centerline of the apparatus 10. Reference numeral 80 in FIG. 5 represents the radius of the drum. Each individual blade has a leading edge facing the intake end 12, a trailing edge facing the discharge end 31, and a top. Each blade is approximately perpendicular or normal to the inner surface of the drum 20 as seen in FIG. 3. As illustrated in FIG. 2, each blade is also angled length-wise in such a manner as to produce an auger effect as the apparatus rotates in the direction of arrow A. That is, the leading edge of the blades are offset from the trailing edge in the direction of travel of the drum. In relation to the axis, this offset can range from about 10 degrees to about 60 degrees. The preferred offset angle, however, is about 20 degrees. The leading edge in the preferred embodiment of the first plurality of first blades 22 may be serrated or tooth-like 25 to enhance the effectiveness of the apparatus. This is best illustrated in FIG. 11.

Large green waste attaches to the plurality of first blades 22, spikes 26, and platforms 28 as the drum 20 rotates. The green waste material is rotated to approximately the top of the drum 20. Gravity and the sheer weight of the materials involved cause the material to dislodge and fall down to the bottom of the drum 20. First falling material strike the opposing blades 22, spikes, 26, and platforms 28. Trailing material strikes the fallen material exerting further force thereon. This process repeats over and over as the drum 20 rotates. From this repetition the green waste material is lifted, dropped, cut, chopped, speared, pierced, shaved, abraded, and crushed until at the discharge end 31 the originally small material generally is pulverized into fine ground waste (fine mulch), originally medium-sized material generally is either pulverized into fine ground waste, regular mulch, or clean wood; and originally large-sized material generally is either reduced to clean wood or returned to the intake end 12 for reprocessing—it is possible for such large material also to be finely ground. By this process, plastic bags and other containers are broken up and the materials within released and processed. Materials such as ice plant, grass, yucca, and palm trees which are not effectively processable by prior art devices are easily processed by the present invention. It is helpful, though not critical, to the process and operation of the apparatus that large green waste remain large or be introduced into the apparatus so that it, by its size and weight, assists in the processing of all green waste.

The plurality of second blades 24 are smaller than the plurality of first blades 22 by about between 30% to 80%. They too are augured and, like the plurality of first blades 22, rotate with the drum 20. The same chopping, cutting, and pulverizing process occurs within this section of plurality of second blades 24. Large green waste is also caught into the plurality of second blades 24, rises with the rotation, and falls onto smaller green waste with the sheer weight pulverizing the smaller waste matter. Both sets of blades, first 22 and second 24, may have teeth-like projections on top to further aid in the cutting, chopping, and pulverizing process. The leading edge in the preferred embodiment of the plurality of second blades 24, like that of the plurality of first blades 22, may be serrated or tooth-like to enhance the effectiveness of the apparatus. This is best illustrated in FIG. 11.

Interspersed among the plurality of first and second blades are a plurality of spike-like members 26 and platforms 28. FIGS. 4 through 7 illustrate the details of these structures. The spikes 26 generally are upstanding protrusions from the inner surface and have pointed ends which pierce, split, and are capable of holding green waste material. Piercing and splitting aids in the pulverization process; holding brings the held material up to the top of the drum 20 as it rotates and, by the weight of the material and limited holding power of the spike 26, drops the material onto other material within the drum and the plurality of blades and other spikes.

Figure 4:
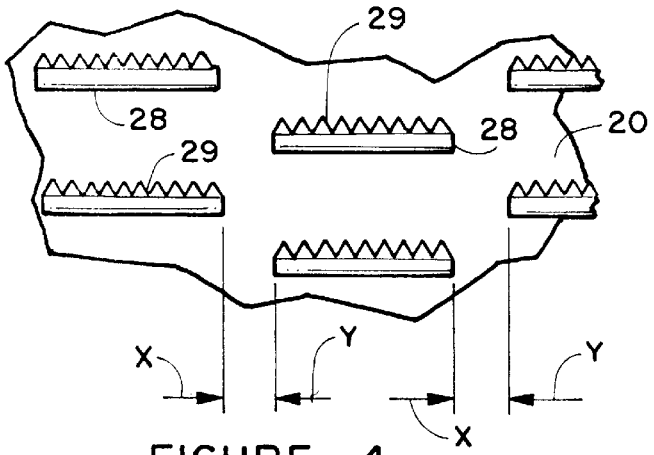
FIG. 4 is a partial sectional view of the inner surface of the drum showing the platform configuration.

The configuration of the platforms 28 is best illustrated in FIGS. 4 and 5. The platforms 28 are shelf-like structures projecting inward from the inner surface of the drum 20. The platforms 28 are approximately parallel to the axis of the drum 20 and somewhat offset from the radius 80 of the drum 20 in the direction of rotation of the drum 20. The angle of offset may be any acute angle ranging from between about 5 degrees to about 40 degrees. The purpose of this acute offset it to grab and hold waste material and larger pieces of wood as the drum 20 rotates up to and generally near the top of the rotation to between about the 2 o'clock and the 10 o'clock position.

The perimeter of the platform may include a plurality of platform projections 29 or teeth-like projections which aid in grabbing and retaining material as the drum 20 rotates and to restrict the release of material until such point that its release and fall onto opposing blades, spikes, and other green waste material has maximum effect.

Platform projections 29 may be configured throughout the entire base of the platform 28, around its perimeter, or in any series of lines and configurations thereon. The platforms 28 generally may be spaced throughout the entire inner surface of the drum 20. As illustrated in FIG. 4, they are approximately horizontally staggered. Also as illustrated in FIG. 4, there exists a longitudinal separation between any series of platforms as denoted by reference character X-Y. X-Y represents the longitudinal distance between the point when one series of platforms ends and the next series of platforms begins.

In a drum having the ranging sizes described earlier with elements having sizes ranging in size as described earlier, all of which establish a multitude of ratios amongst each other, the X-Y distance establishes a relative ratio therewith using as a range of distances, by way of example only, of about 6.000 inches to about 3.000 feet. The same principle is true of the platform longitudinal dimensions. As such the platform dimensions may range from about 2.000 feet to about 10.000 feet. The width of the platform, distance of projection from the inner surface may range from about 6.000 inches to about 5.000 feet.

Throughout its movement within the drum 20 and engagement with the plurality of first blades 22 and the plurality of second blades 24, large green waste and wood is slowly and finely made smaller; medium and small sized green waste is virtually pulverized into finely ground material or mulch. All types of green waste (fibrous and moist) are so processed without restriction. As the green waste moves further and further through the apparatus, it becomes much smaller and finer.

Figure 8:
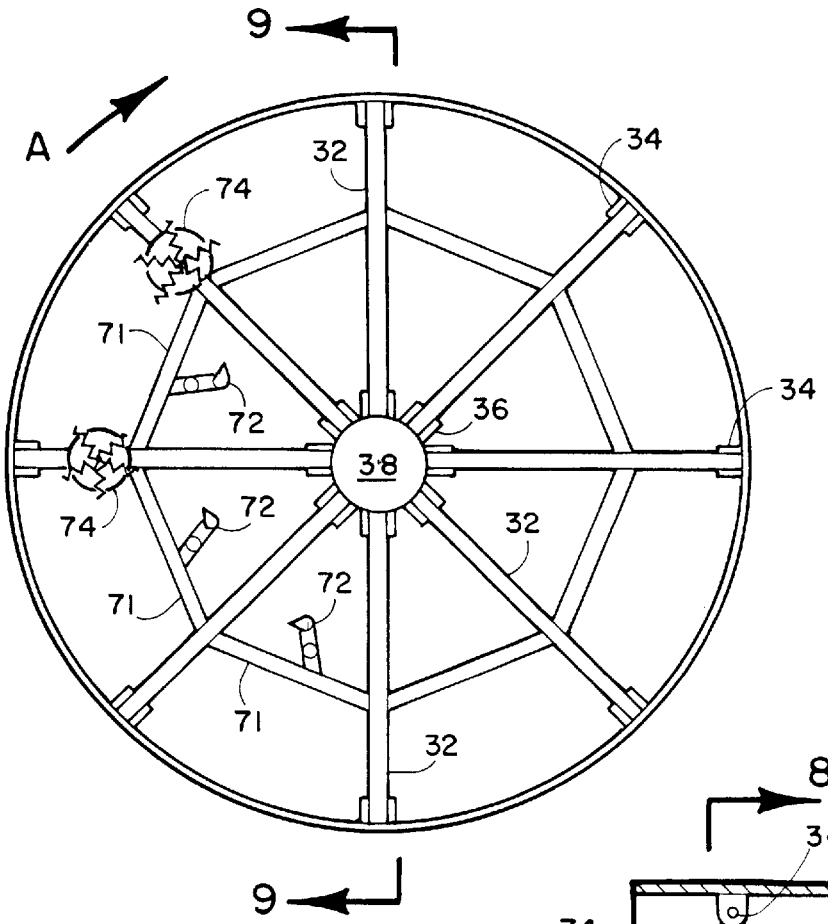
FIG. 8 is a front elevation view of the end cap housed within the present invention.
Figure 9:
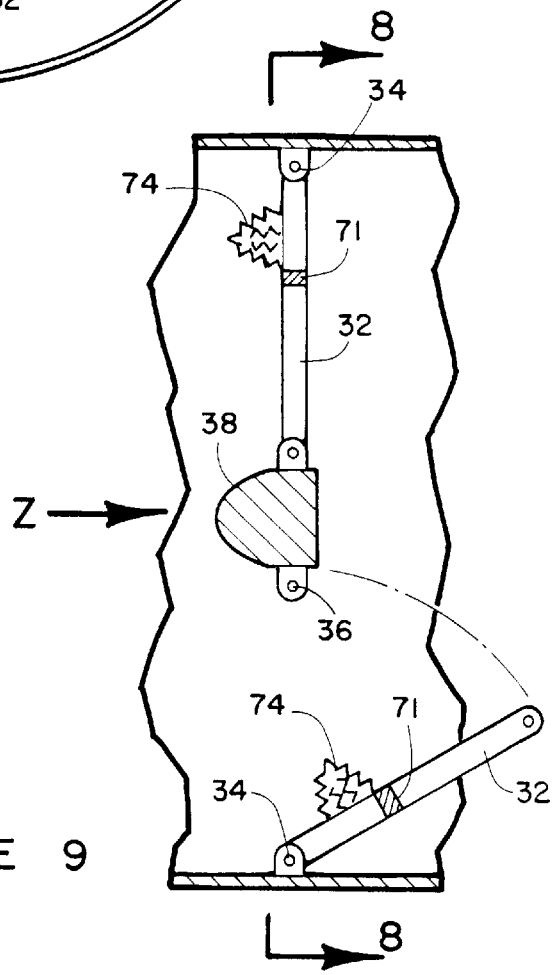
FIG. 9 is a side elevation view of the end cap.

FIGS. 8 and 9 illustrate the detail of the end cap 30 configuration. At end cap 30, only processed green waste matter of a limited size is permitted to pass. End cap 30 has a plurality radial members 32 (or retainer members) emanating from a center member 38 outward to the circumferential inner surface of the cylinder. One, some, or all of the radial members 32 may be pivotably attached at the inner surface of the cylinder by the pivot member 34. One, some, or all of the radial members may be releasably and removably connected to retainers 36 on the center member 38. One, some, or all of the radial members 32 may be so pivotably attached and releasably and removably connected. The widest width between the radial members 32 dictates the largest size of processed green waste which can pass through. This prevents passage of green waste which is too large which may cause damage to the apparatus, the screening members, or the conveyors. The releasability and removability of the radial members 32 permits the user to increase or decrease the largest size of processed green waste to pass therethrough and further facilitates unclogging and cleaning the apparatus.

Figure 10:
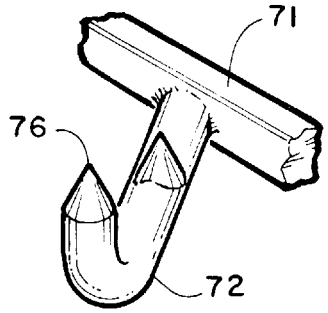
FIG. 10 is a detailed view of a grabbing member.

A cross member 71 connects between any two radial members 32. This cross member 71 may be releasably connected or permanently connected to the radial members 32. Any number of such cross members 71 may be so connected to adjacent radial members 32. Attached to any one, some, or all the cross members 71 is a grabbing member 72. The grabbing member may be a hook-like structure, an angled structure, or a curved structure having at its furthest end a somewhat sharp point 76 suited to pierce or cut into the materials it contacts. For best results, this end point may generally be angled toward the direction of rotation of the cylinder 20; although any angle will suffice. As illustrated in FIG. 10, the grabbing member 72 may be configured with more than one such sharp point 76. This facilitates the grabbing and holding of the materials, particularly larger materials. It also facilitates in the pulverization process. Any one, some, or all of the grabbing members 72 may be permanently affixed to the cross member 71 or releasably connected thereto.

Also connected to one, some, or all of the radial members 32 is a hub member 74. Like the grabbing member 72, one, some, or all of the hub members 74, may be permanently affixed to the radial members 32 or removably attached thereto. The hub members 74 may be of any geometric shape, although a somewhat cone-shape is preferred. The outer surface of the hub member 74 is somewhat if not substantially roughened. It may consist of a composite of particles, of large grains, of blade-like implements, or of serrations. In the preferred embodiment, the outer surface of the hub member 74 is somewhat serrated as illustrated in FIG. 9. The hub member 74, like the grabbing member 72 aids in the pulverization process and reduces and unclogs any clumped materials at the end cap 30.

As processed green waste passes through the end cap 30, processed material which is suitably ground into fine mulch-like material enters and passes through the first screening member 42, unto the first conveyor 52, and out for recapture and re-use as noted by the direction arrow B. Residue material (clean wood) passes onto the second screening member 46 and, if of a suitable size, passes through and onto the second conveyor 56 and out for recapture and re-use as noted by the direction arrow C. Larger residue which cannot pass through the first and second screening members 42 and 46, is carried out to the third conveyor 58 in the direction of arrow D for further triage following the direction of arrows E or F as the case may be. This could result in the materials being returned to the intake end 12, materials being discarded, or materials suited for other re-cycling methods such as, but not limited to, small firewood.

Atop of each screening member is a cleaning member 50, such as a brush or other tapping device, suited to clean clogged debris from each screening member so that processed green waste can pass therethrough. This cleaning member 50 can be permanently affixed to the apparatus, can be removable, can be stationary thereon, or can engage in a translating or reciprocal motion. Also atop and/or around the cylinder 20 is a moisture introduction member 60 adapted to retard dust build-up or dust dispersion. The addition of such moisture also enhances the quality of the finer processed green waste emanating from the first screening member 42. Introduction of moisture may be as a mist, a stream, or any steady flow of moisture needed for the particular processing involved. The water introduction member 60 may be located adjacent to the end cap 30, at the discharge end 31, or at the intake end 12 of the apparatus. Placing at the intake end 12 or as a collar thereat are preferred.

What adds greater utility and versatility to the apparatus lies in the fact that the drum may be made up of sections which are individually removable and replaceable as need dictates without disrupting the rest of the apparatus. Similarly, the blades (first 22 and second 24 pluralities), the spikes 26, the platforms 28, the radial members 32, the cross members 71, the grabbing members 71, the hub members 72, and the screening members 42 and 44 are or may be individually removable and replaceable as need dictates. Larger or small elements may be substituted depending on the scope of the processing operation and all angles discussed herein may be adjusted.

The present disclosure includes that contained in the foregoing description. Although this invention has been described in its preferred form with a certain degree of particularity, it is understood that the present disclosure of the preferred form has been made only by way of example and numerous changes in the details of construction and combination and arrangement of without departing from the spirit and scope of the invention. Accordingly, the scope of the invention should be determined not by the embodiment[s] illustrated, but by the their legal equivalents as well.

What is claimed is:

1. An apparatus for processing green waste comprising a. rotatable drum having an intake end, a discharge end, an inner surface, and an axis;

b. a plurality of first blade members on said inner surface, said plurality of first blade members each having a top, a leading edge, and a trailing edge wherein said leading edge is angled away from said trailing edge in a direction of rotation of said rotatable drum;

c. a first screening member adjacent to said discharge end, said first screening member adapted to permit passage therethrough of ground green waste ranging in size of up to about 4.000 inches; and d. a cutting member connected to the inner surface of the drum, said cutting member having a center and further having a length approximately equal to a diameter of the inner surface.

2. The apparatus as defined in claim 1 wherein said first screening member is comprised of a plurality of apertures having openings ranging is size from about 0.125 inch to about 0.625 inch.

3. The apparatus as defined in claim 1 wherein said first screening member is comprised of a plurality of apertures having openings ranging in size of about 0.500 inch.

4. The apparatus as defined in claim 1 further comprising a cleaning member to clean said first screening member.

5. The apparatus as defined in claim 4 further comprising a means for conveying said ground green waste from said first screening member.

6. The apparatus as defined in claim 1 wherein said rotatable drum is circular.

7. The apparatus as defined in claim 1 wherein said rotatable drum is polygonal.

8. The apparatus as defined in claim 1 wherein said plurality of first blade members are vertically normal to said inner surface of said rotatable drum.

9. The apparatus as defined in claim 1 wherein said plurality of first blade members further have one or more teeth-like projections on said top.

10. The apparatus as defined in claim 1 wherein said plurality of first blade members further have one or more teeth-like projections on said leading edge.

11. The apparatus as defined in claim 1 wherein said apparatus further comprises a plurality of spike members on said inner surface.

12. The apparatus as defined in claim 1 further comprising a moisture introduction member for moistening said processing green waste.

13. The apparatus as defined in claim 1 further comprising a second screening member adapted to permit passage of residue ranging in size of up to about 4.000 inches but not passage of larger residue.

14. The apparatus as defined in claim 13 wherein said second screening member is comprised of a plurality of apertures having openings ranging is size from about 1.500 inches to about 2.500 inches.

15. The apparatus as defined in claim 13 wherein said second screening member is comprised of a plurality of apertures having openings ranging in size of about 2.000 inch.

16. The apparatus as defined in claim 13 further comprising a cleaning member to clean said second screening member.

17. The apparatus as defined in claim 13 further comprising a means to convey said passed residue from said second screening member.

18. The apparatus as defined in claim 1 further comprising a plurality of second blade members adjacent to said discharge end, said plurality of second blade members having a top, a leading edge, and a trailing edge and further being smaller than said plurality of first blade members.

19. The apparatus as defined in claim 18 wherein said leading edge of said plurality of second blade members is longitudinally angled away from said trailing edge of said plurality of second blade members in a direction of rotation of said rotatable drum.

20. The apparatus as defined in claim 18 wherein said plurality of second blade members are vertically normal to said inner surface of said rotatable drum.

21. The apparatus as defined in claim 18 wherein said plurality of second blade members further have one or more teeth-like projections on said top.

22. The apparatus as defined in claim 18 wherein said plurality of second blade members further have one or more teeth-like projections on said leading edge.

23. The apparatus as defined in claim 1 further comprising an end cap adjacent to said discharge end, said end cap having a center member and more than one radial member, each said more than one radial member having one end attached to said inner surface and a second end attached to said center member.

24. The apparatus as defined in claim 23 wherein said more than one radial member is removable from said apparatus.

25. The apparatus as defined in claim 23 further comprising at least one hub member connected to said more than one radial member, said at least one hub member facing the intake end and further having an outer surface.

26. The apparatus as defined in claim 25 wherein said outer surface of said at least one hub member is roughened.

27. The apparatus as defined in claim 23 further comprising at least one cross member in between two adjacent said more than one radial member.

28. The apparatus as defined in claim 27 further comprising at least one grabbing member connected to said at least one cross member, said at least one grabbing member facing the intake end.

29. The apparatus as defined in claim 28 wherein said at least one grabbing member has at least one sharp point thereon, said at least one sharp point is an end point which is angled from said at least one grabbing member in a direction of rotation of said apparatus.

30. The apparatus as defined in claim 1 further comprising a plurality of platform members projecting from said inner surface.

31. The apparatus as defined in claim 30 wherein said plurality of platform members are approximately parallel to the axis of said rotatable drum.

32. The apparatus as defined in claim 30 wherein said plurality of platform members are angled acutely in the direction of rotation of said rotatable drum.

33. The apparatus as defined in claim 30 wherein said plurality of platform members further have platform projections thereon.

34. The apparatus as defined in claim 1 wherein said cutting member is positioned approximately midway between said intake end and said discharge end.

35. The apparatus as defined in claim 1 wherein said cutting member comprises at least one cutting edge adapted to face in a direction of rotation of the rotatable drum.

36. The apparatus as defined in claim 35 wherein said at least one cutting edge of said cutting member is angled away from an opposite edge of said at least one cutting edge.

* * * * *